US011065904B2

(12) United States Patent
Dobashi et al.

(10) Patent No.: US 11,065,904 B2
(45) Date of Patent: Jul. 20, 2021

(54) IMAGE FORMING SYSTEM AND IMAGE FORMING METHOD

(71) Applicant: TOSHIBA TEC KABUSHIKI KAISHA, Tokyo (JP)

(72) Inventors: Shoichi Dobashi, Sunto Shizuoka (JP); Yasunobu Terao, Izunokuni Shizuoka (JP); Yoshiaki Sugizaki, Sunto Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/776,426

(22) Filed: Jan. 29, 2020

(65) Prior Publication Data

US 2020/0290393 A1 Sep. 17, 2020

(30) Foreign Application Priority Data

Mar. 15, 2019 (JP) ..... JP2019-049111
Sep. 6, 2019 (JP) ..... JP2019-163417

(51) Int. Cl.
*B42C 1/12* (2006.01)
*B65H 31/34* (2006.01)
*B65H 37/04* (2006.01)

(52) U.S. Cl.
CPC ..... *B42C 1/12* (2013.01); *B65H 31/34* (2013.01); *B65H 37/04* (2013.01); *B65H 2301/4213* (2013.01); *B65H 2801/27* (2013.01)

(58) Field of Classification Search
CPC ..... B42C 1/12; G03G 15/6541; G03G 2215/00822; G03G 2215/00827;
(Continued)

(56) References Cited

U.S. PATENT DOCUMENTS 8,146,908 B2 4/2012 Terao
9,139,397 B2 * 9/2015 Sato ..... B31F 5/00
(Continued)

FOREIGN PATENT DOCUMENTS

JP 2004043037 A 2/2004

OTHER PUBLICATIONS

Espacenet translation of JP2004043037A, http://translationportal.epo.org/emtp/translate/?ACTION=description-retrieval&COUNTRY=JP&ENGINE=google&FORMAT=docdb&KIND=A&LOCALE=en_EP&NUMBER=2004043037&OPS=ops.epo.org/3.2&SRCLANG=ja&TRGLANG=en (Year: 2004).*
(Continued)

*Primary Examiner* — Leslie A Nicholson, III
(74) *Attorney, Agent, or Firm* — Kim & Stewart LLP

(57) ABSTRACT

An image forming apparatus includes a processing tray, a post-processing controller, and a detection sensor. The processing tray is configured to support a sheet or a sheet bundle on which a post-processing is to be executed. The post-processing controller is configured to execute the post-processing on the sheet positioned on the processing tray. The detection sensor is configured to detect an object in a predetermined detection range including a space above the processing tray. The post-processing controller stops execution of the post-processing when the detection sensor detects the object at a determination timing other than a timing at which passage of the sheet or the sheet bundle through the detection range is estimated.

20 Claims, 14 Drawing Sheets

(58) Field of Classification Search
CPC B65H 31/34; B65H 37/04; B65H 2301/4213; B65H 2801/27
USPC ..... 270/58.11, 58.12, 58.02
See application file for complete search history.

(56) References Cited

U.S. PATENT DOCUMENTS

| | | | | |
|---|---|---|---|---|
| 9,221,647 | B2 * | 12/2015 | Furuhashi | B31F 1/10 |
| 9,394,136 | B2 * | 7/2016 | Kubo | B65H 31/02 |
| 2011/0033218 | A1 | 2/2011 | Sasahara | |
| 2012/0104689 | A1 | 5/2012 | Tamada et al. | |
| 2020/0172359 | A1 * | 6/2020 | Nanno | G03G 15/754 |

OTHER PUBLICATIONS

Extended European Search Report dated Jul. 21, 2020 in related European Patent Application 20161766.9, 8 pages.

* cited by examiner

IMAGE FORMING SYSTEM AND IMAGE FORMING METHOD

CROSS-REFERENCE TO RELATED APPLICATION

The present application is based upon and claims the benefit of priorities from Japanese Patent Application No. 2019-049111 filed on Mar. 15, 2019 and Japanese Patent Application No. 2019-163417 filed on Sep. 6, 2019, the entire contents of which are hereby incorporated by reference.

FIELD

Embodiments described herein relate generally to an image forming system and an image forming method.

BACKGROUND

An image forming apparatus executes a post-processing such as a stapling process after forming an image on a sheet. In this image forming apparatus, a space for executing the post-processing is provided. After the execution of the post-processing, the sheet is discharged. Therefore, the space for executing the post-processing is connected to the outside. Accordingly, when an object enters into the space from the outside, a post-processing apparatus may be broken.

DETAILED DESCRIPTION

Figure 1:
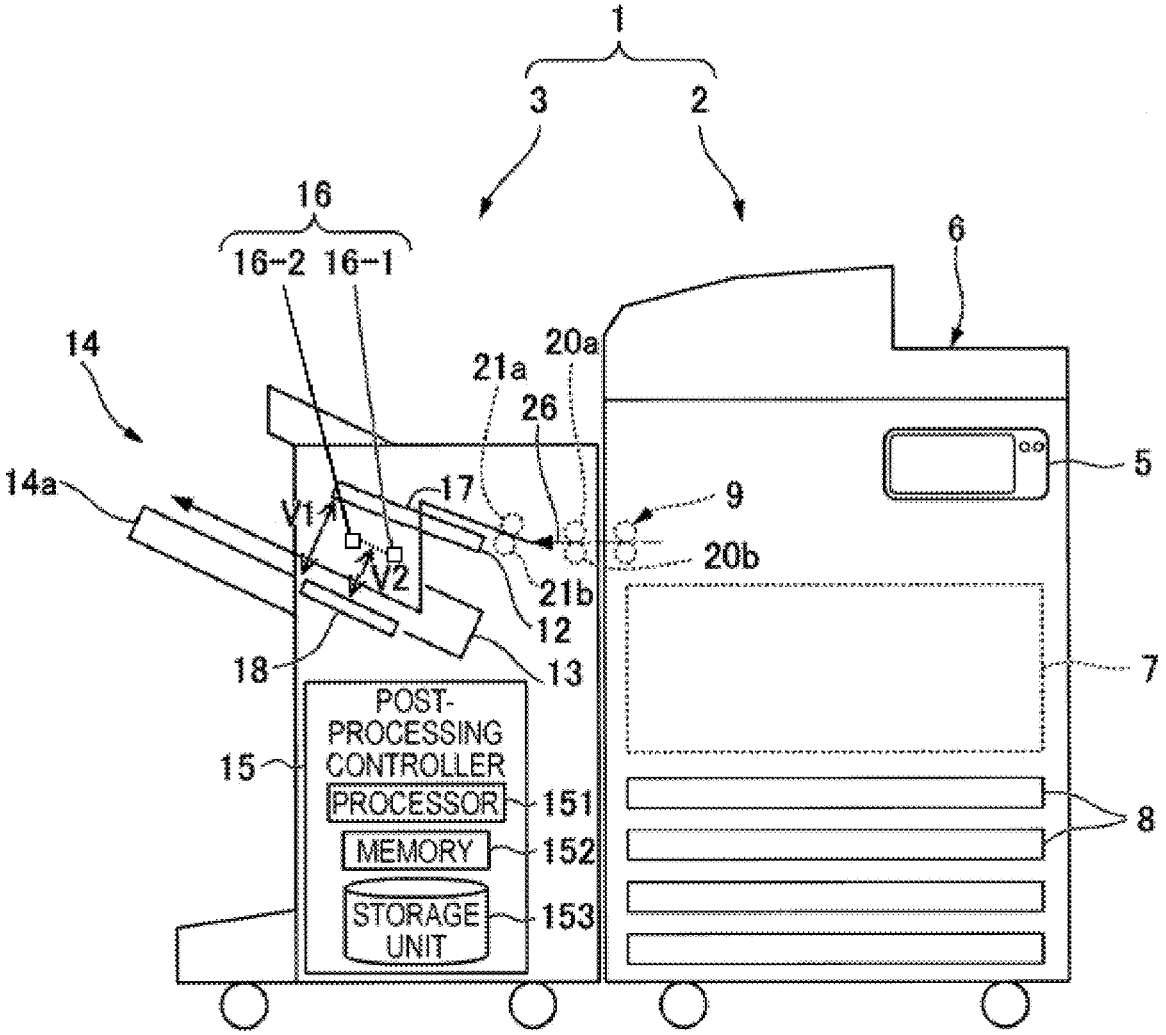
FIG. 1 is a schematic diagram illustrating a hardware configuration of an image forming system according to an embodiment.

Embodiments provide an image forming system and an image forming method in which a breakdown can be prevented when an object enters into a post-processing apparatus from the outside.

In general, according to one embodiment, there is provided an image forming apparatus including a processing tray, a post-processing controller, and a detection sensor. The processing tray is configured to support a sheet or a sheet bundle on which a post-processing is to be executed. The post-processing controller is configured to execute the post-processing on the sheet positioned on the processing tray. The detection sensor is configured to detect an object in a predetermined detection range including a space above the processing tray. The post-processing controller stops execution of the post-processing when the detection sensor detects the object at a determination timing other than a timing at which passage of the sheet or the sheet bundle through the detection range is estimated.

Hereinafter, an image forming system and an image forming method according to an embodiment will be described with reference to the drawings.

A post-processing apparatus 3 in an image forming system 1 according to the embodiment will be described with reference to FIGS. 1, 2, and 3.

The image forming system 1 includes an image forming apparatus 2 (MFP) and the post-processing apparatus 3. The image forming apparatus 2 forms an image on a sheet-shaped recording medium (hereinafter, referred to as "sheet S") such as a paper. The post-processing apparatus 3 executes a post-processing on the sheet S conveyed from the image forming apparatus 2. The post-processing may be any processing as long as it is a processing that is executed after the image forming apparatus 2 forms an image. The post-processing may be, for example, a stapling process. Hereinafter, for simplification of the description, it is assumed that the post-processing is a stapling process. Hereinafter, a bundle of sheets in which a plurality of sheets S are stacked will be referred to as "sheet bundle SS".

The image forming apparatus 2 includes a processor, a memory, and an auxiliary storage device connected via a bus and executes a program. By executing the program, the image forming apparatus 2 functions as an apparatus including a control panel (operation unit) 5, a scanner unit 6, a printer unit 7, a paper feed unit 8, and a paper discharge unit 9.

The control panel 5 includes various keys, a touch panel, or the like that receives an operation of a user. The control panel 5 receives an input relating to the kind of the post-processing of the sheet S. The user can operate the control panel 5 to select any one mode from an automatic post-processing mode where the post-processing is executed by the post-processing apparatus 3 without receiving a manual operation from the user and a manual operation mode where the post-processing is executed by the post-processing apparatus 3 while receiving a manual operation from the user.

In the manual operation mode, the control panel 5 receives an input of information (hereinafter, referred to as "stapling position information") regarding a position where the sheet bundle SS is to be stapled. In the manual operation mode, the control panel 5 receives an input of information (hereinafter, referred to as "lowering instruction information") regarding an instruction to lower the pinch roller 47. The image forming apparatus 2 transmits the information regarding the kind of the post-processing input by the control panel 5 to the post-processing apparatus 3. In the manual operation mode, the control panel 5 receives an input of execution information. The execution information is information regarding an instruction to execute the post-processing.

The scanner unit 6 includes a scanning unit that reads image information of an image to be copied. The scanner unit 6 transmits the read image information to the printer unit 7. The printer unit 7 forms an output image using a developer such as toner based on the image information transmitted from the scanner unit 6 or an external apparatus. The printer unit 7 applies heat and pressure to the toner image transferred to the sheet S to fix the toner image to the sheet S.

The paper feed unit 8 supplies the sheet S to the printer unit 7 one by one at a timing at which the printer unit 7 forms the toner image. The paper discharge unit 9 conveys the sheet S discharged from the printer unit 7 to the post-processing apparatus 3.

Next, the post-processing apparatus 3 will be described.

As illustrated in FIG. 1, the post-processing apparatus 3 is positioned at a position adjacent to the image forming apparatus 2. The post-processing apparatus 3 executes a post-processing on the sheet S conveyed from the image forming apparatus 2, the post-processing being designated through the control panel 5.

The post-processing apparatus 3 includes a processor 151, a memory 152, and a storage unit 153 connected via a bus and executes a program. By executing the program, the post-processing apparatus 3 functions as an apparatus including a standby unit 12, a processing unit 13, a discharge unit 14, a post-processing controller 15, a sensor transmitter 16-1, and a sensor receiver 16-2. The storage unit 153 is configured using a storage device such as a magnetic hard disk device or a semiconductor memory device. The storage unit 153 stores various information relating to the image forming system 1.

The standby unit 12 temporarily retains (buffers) the sheet S conveyed from the image forming apparatus 2. The standby unit 12 includes a standby tray 17. For example, the standby unit 12 makes a plurality of succeeding sheets S standby while a post-processing of the preceding sheet S is being executed by the processing unit 13. The standby unit 12 is positioned above the processing unit 13. For example, the standby unit 12 makes a plurality of preset sheets S standby in a state where the sheets S are stacked. When the processing unit 13 is empty, the standby unit 12 makes the retained sheet S fall toward the processing unit 13. More specifically, the standby unit 12 makes the retained sheet S fall toward a processing tray 18 included in the processing unit 13. The processing tray 18 supports a sheet on which a post-processing is to be executed.

The processing unit 13 executes the post-processing on the conveyed sheet S. The processing unit 13 includes the processing tray 18. The processing unit 13 executes the post-processing on the sheet bundle SS in which a plurality of sheets S are aligned. The post-processing that is executed by the processing unit 13 is a stapling process that is a binding process using a stapler 35. The processing unit 13 discharges the sheet S on which the post-processing is executed to the discharge unit 14.

As illustrated in FIG. 1, a movable tray 14*a* is positioned at a side portion of the post-processing apparatus 3. The movable tray 14*a* is movable in a vertical direction along the side portion of the post-processing apparatus 3. The sheet S is discharged from the standby unit 12 and the processing unit 13 to the movable tray 14*a*.

The post-processing controller 15 controls an overall operation of the image forming apparatus 2 and the post-processing apparatus 3. The post-processing controller 15 is formed with a control circuit including the processor 151, the memory 152, and the storage unit 153. The post-processing controller 15 controls operations of the respective functional units of the post-processing apparatus 3. For example, the post-processing controller 15 controls the standby unit 12, the processing unit 13, and the discharge unit 14. The post-processing controller controls operation of inlet rollers 20*a* and 20*b* and outlet rollers 21*a* and 21*b* such that the inlet rollers 20*a* and 20*b* and the outlet rollers 21*a* and 21*b* convey the sheet S up to the standby tray 17. The post-processing controller 15 controls operations of the sensor transmitter 16-1 and the sensor receiver 16-2. The post-processing controller 15 controls an operation of the processing unit 13.

The sensor transmitter 16-1 and the sensor receiver 16-2 operate in cooperation to detect an object. The sensor transmitter 16-1 includes a light emitting element that is a light source of an electromagnetic wave such as a light emitting diode (LED). The sensor receiver 16-2 includes a light receiving element that receives an electromagnetic wave radiated from the sensor transmitter 16-1. The sensor receiver 16-2 outputs information (hereinafter, referred to as "sensor information") regarding whether or not the object is detected in a space inside a detection range. The detection range is a space where the electromagnetic wave radiated from the sensor transmitter 16-1 propagates. That is, the detection range is a space where the sensor transmitter 16-1 and the sensor receiver 16-2 operate in cooperation to detect the object.

When a predetermined condition (hereinafter, referred to as "detection condition") relating to a reception state where the electromagnetic wave is received by the sensor transmitter 16-1 is satisfied, the sensor receiver 16-2 may output the sensor information indicating that the object is detected in the space inside the detection range in any reception state. For example, when the electromagnetic wave transmitted from the sensor transmitter 16-1 cannot be received by the sensor receiver 16-2, the sensor information output from the sensor receiver 16-2 may indicate that the object is detected in the space inside the detection range. For example, when an intensity in which the electromagnetic wave transmitted from the sensor transmitter 16-1 is received by the sensor receiver 16-2 is lower than or equal to a predetermined intensity, the sensor information output from the sensor receiver 16-2 may indicate that the object is detected in the space inside the detection range. Hereinafter, a pair of the sensor transmitter 16-1 and the sensor receiver 16-2 will be referred to as "sensor pair 16". The sensor pair 16 is not particularly limited as long as the object is detected in a predetermined detection range including a space above the processing tray 18. The sensor pair 16 may be, for example, a transmission sensor.

The sensor pair 16 may be disposed at any position as long as it is disposed at a position that satisfies a transmitter condition and a receiver condition. The transmitter condition is a condition that the sensor transmitter 16-1 is disposed at a position where an electromagnetic wave parallel to the processing tray 18 can radiate to a space (hereinafter, referred to as "post-processing space") between the processing tray 18 and the standby tray 17. The receiver condition is a condition that the sensor receiver 16-2 is disposed at a position where the electromagnetic wave radiated from the sensor transmitter 16-1 can be received.

For example, when the height from the processing tray 18 to the standby tray 17 is represented by V1, the sensor transmitter 16-1 may be disposed at a position V2 where the height from the processing tray 18 is lower than V1, and the sensor receiver 16-2 may be disposed at the position V2 where the height from the processing tray 18 is lower than V1. V2 may be, for example, 15 mm. When V2 is 15 mm, for example, the average size of the back of a hand of a child is 20 mm. Therefore, in the image forming system 1, the hand of the child inserted into the post-processing space can be detected by the sensor pair 16. On the other hand, when V2 is 15 mm, the image forming system 1 does not detect the sheet bundle SS that is thinner than 15 mm.

Hereinafter, a configuration of each component of the post-processing apparatus 3 will be described in more detail.

In the embodiment, "upstream side" and "downstream side" refer to an upstream side (image forming apparatus 2 side) and a downstream side (movable tray 14*a* side) in a conveying direction of the sheet S, respectively. "Front end portion" and "rear end portion" refer to "downstream side end portion" and "upstream side end portion" in a sheet conveying direction, respectively. Further, in the embodiment, a direction (sheet plane direction) that is substantially parallel to a plane of the sheet S and is substantially perpendicular to the sheet conveying direction will be referred to as "sheet width direction W".

Figure 2:
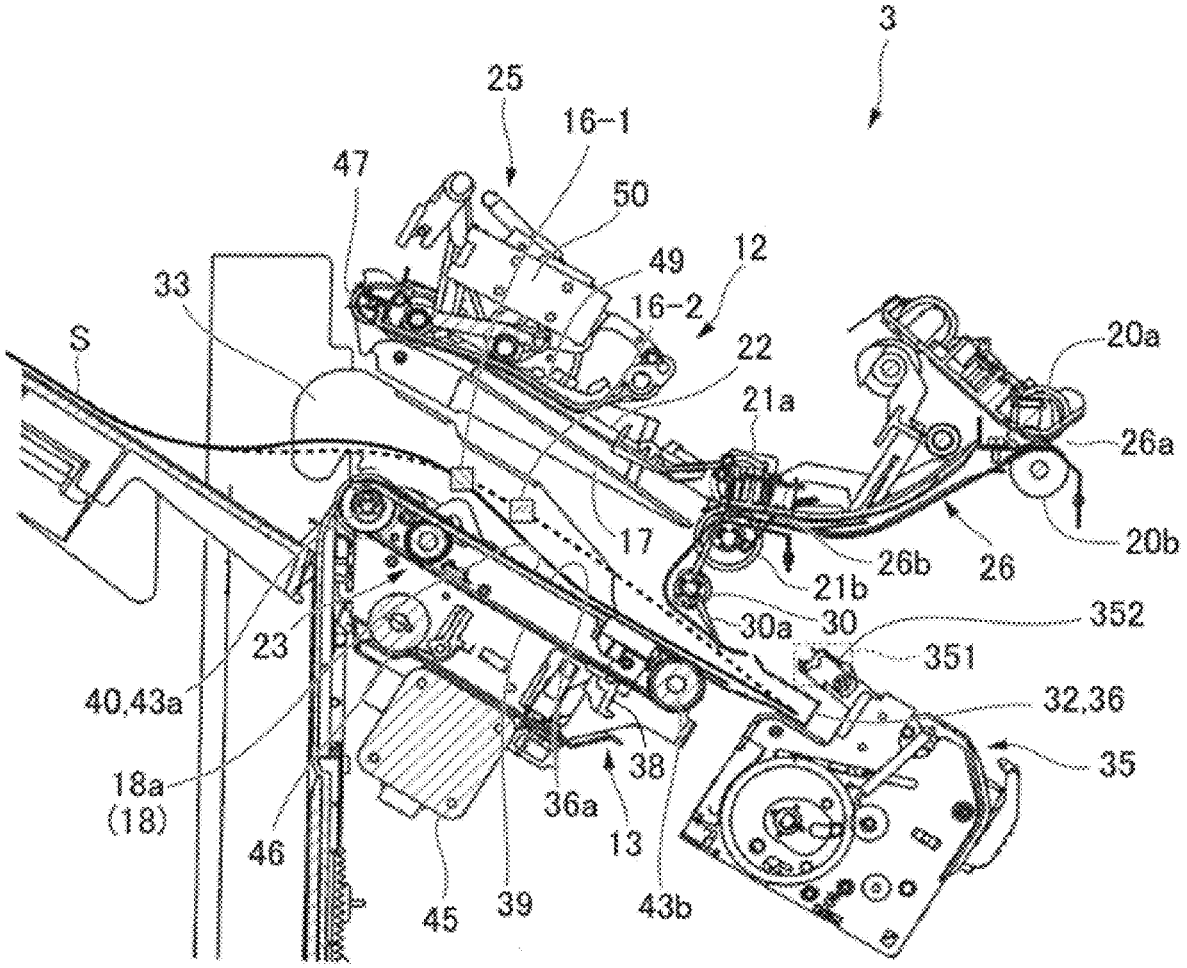
FIG. 2 is a schematic diagram illustrating a hardware configuration of a post-processing apparatus according to the embodiment.

As illustrated in FIGS. 1 and 2, the post-processing apparatus 3 includes a conveyance path 26 of the sheet S leading to the paper discharge unit 9 of the image forming apparatus 2. The post-processing apparatus 3 includes the pair of inlet rollers 20*a* and 20*b* and the pair of outlet rollers 21*a* and 21*b* in the conveyance path 26, the standby unit 12, the processing unit 13, the pinch roller 47, and a pinch roller driving mechanism 25. The conveyance path 26 is provided inside the post-processing apparatus 3.

The conveyance path 26 includes: a sheet supply port 26*a* where the inlet rollers 20*a* and 20*b* are provided; and a sheet discharge port 26*b* where the outlet rollers 21*a* and 21*b* are provided. The sheet supply port 26*a* faces the paper discharge unit 9 of the image forming apparatus 2. The sheet S is supplied from the image forming apparatus 2 to the sheet supply port 26*a*. The sheet discharge port 26*b* faces the standby unit 12. The sheet S past the conveyance path 26 is conveyed from the sheet discharge port 26*b* to the standby unit 12.

As illustrated in FIGS. 1 and 2, the conveyance path 26 guides the sheet S to the standby unit 12. The conveyance path 26 extends toward the vertical alignment roller 40 (conveying roller) in the processing unit 13 positioned downstream of the standby unit 12 in the conveying direction.

As illustrated in FIGS. 1 and 2, the inlet rollers 20*a* and 20*b* are provided in the vicinity of the sheet supply port 26*a*. The inlet rollers 20*a* and 20*b* are parallel to each other and face each other in a radial direction. The inlet roller 20*a* is a driving roller disposed on an upper surface side of the conveyance path 26. The inlet roller 20*b* is a driven roller disposed on a lower surface side of the conveyance path 26. The sheet S is interposed at a nip between the inlet rollers 20*a* and 20*b*. The inlet rollers 20*a* and 20*b* convey the interposed sheet S to the downstream side in the conveying direction.

The outlet rollers 21*a* and 21*b* are provided in the vicinity of the sheet discharge port 26*b*. The outlet rollers 21*a* and 21*b* are parallel to each other and face each other in a radial direction. The outlet roller 21*a* is a driven roller disposed on the upper surface side of the conveyance path 26. The outlet roller 21*b* is a driving roller disposed on the lower surface side of the conveyance path 26. The sheet S is interposed at a nip between the outlet rollers 21*a* and 21*b*. The outlet rollers 21*a* and 21*b* convey the interposed sheet S to the downstream side in the conveying direction.

The standby unit 12 includes the standby tray (buffer tray) 17 and an assist guide 22. A rear end portion of the standby tray 17 is positioned in the vicinity of the outlet rollers 21*a* and 21*b*. The rear end portion of the standby tray 17 is positioned to be lower than the sheet discharge port 26*b* of the conveyance path 26. The standby tray 17 is inclined with respect to a horizontal direction as it gradually becomes higher toward the downstream side in the sheet conveying direction. The standby tray 17 makes a plurality of sheets S standby in a state where the sheets S are stacked while the post-processing is being executed by the processing unit 13.

The standby tray 17 includes a pair of tray members that can move toward or away from each other in the sheet width direction W. When the sheet S stands by in the standby tray 17, the pair of tray members move toward each other to support the sheet S. When the sheet S is moved from the standby tray 17 toward the processing tray 18 of the processing unit 13, the pair of tray members move away from each other to make the supported sheet S fall (move) toward the processing tray 18.

A paddle unit 30 is provided between the upstream side of the standby tray 17 and the upstream side of the processing tray 18. The paddle unit 30 rotates around a rotation axis along the sheet width direction W such that the sheet S is pressed toward the processing tray 18. When the sheet S moves from the standby tray 17 toward the processing tray 18, the paddle unit 30 presses a rear end portion of the sheet S toward the processing tray 18. The paddle unit 30 includes a paddle 30*a* that is formed of an elastic material such as rubber, and the rear end portion of the sheet S is pressed toward the processing tray 18 by the paddle 30*a*.

As illustrated in FIG. 2, the processing unit 13 includes the processing tray 18, a horizontal alignment plate 33, a rear end stopper 32, a binding processing unit (e.g. stapler) 35, an ejector 36, a thruster 36*a*, a bundle pawl 38, a bundle pawl belt 39, a vertical alignment roller (conveying roller), and belt pulleys 43*a* and 43*b*.

The processing tray 18 is provided below the standby tray 17. The processing tray 18 is inclined with respect to the horizontal direction as it gradually becomes higher toward the downstream side in the sheet conveying direction. For example, the processing tray 18 is inclined to be substantially parallel to the standby tray 17. The processing tray 18 includes a conveyance surface 18*a* on which the sheet S is supported (the sheet S is placed).

A pair of horizontal alignment plates 33 are provided to face opposite surfaces of the conveyance surface 18*a* of the processing tray 18 in the sheet width direction W. The pair of horizontal alignment plates 33 are provided to be separated from each other in the sheet width direction W. The horizontal alignment plates 33 are movable in a direction in which they move toward each other in the sheet width direction W and in a direction in which they move away from each other in the sheet width direction W. The horizontal alignment plates 33 configure a horizontal alignment apparatus that executes alignment (so-called horizontal alignment) of the sheet S in the sheet width direction W.

The rear end stopper 32 is provided at an upstream side end portion of the processing tray 18. The vertical alignment roller 40 is driven clockwise in the drawing such that the sheet S placed on the processing tray 18 is conveyed toward the rear end stopper 32. The vertical alignment roller 40 executes vertical alignment of the sheet S in cooperation with the paddle unit 30 by making the upstream side end of the sheet S abut against the rear end stopper 32. The vertical alignment roller 40 is driven counterclockwise in the drawing in cooperation with the paddle unit 30 that presses the rear end portion of the sheet S such that the thin and light-weight sheet S or the curved sheet S is extended.

The stapler 35 is disposed in the rear of the processing tray 18. The stapler 35 includes a staple clinch 351. The stapler 35 can clinch end portions of the sheets S that abut against the rear end stopper 32 and are aligned. Using the staple clinch 351, the stapler 35 staples the end portion of the sheet bundle SS that abuts against the rear end stopper 32 and is aligned.

The stapler 35 is movable so as to staple a position on the sheet bundle SS that is instructed by the user through the control panel.

The stapler 35 includes a staple head sensor 352. The staple head sensor 352 detects that a head portion of a staple is positioned at a head portion of a staple housing portion of the stapler 35. When the staple head sensor 352 does not detect the staple, the output value of the staple head sensor 352 represents that the head portion of the staple is not positioned at the head portion of the staple housing portion. When the staple head sensor 352 detects the staple, the output value of the staple head sensor 352 represents that the head portion of the staple is positioned at the head portion of the staple housing portion. The head portion of the staple advances toward the head portion of the staple housing portion when a null stapling operation is executed. This null stapling operation will also be referred to as "advancing operation" of the staple.

The ejector 36 is provided at an initial position of an upstream side end portion of the processing tray 18. The ejector 36 is provided so as to overlap the rear end stopper 32 in a side view. The ejector 36 can move the sheet S to the downstream side in the conveying direction. When moving to the downstream side in the conveying direction, the ejector 36 advances the sheet bundle SS on which the post-processing is executed. The ejector 36 disposes the end portion of the sheet bundle SS at a position where the sheet bundle SS can be picked up by the bundle pawl 38. The ejector 36 is biased toward the initial position before the movement.

The bundle pawl belt 39 and the belt pulleys 43*a* and 43*b* configure a bundle pawl driving mechanism 23 that drives the bundle pawl 38. The bundle pawl driving mechanism 23 includes a bundle pawl drive motor 45 as a drive source common to the bundle pawl 38 (belt pulley 43*a*), the ejector 36, and the thruster 36*a*. The bundle pawl drive motor 45 is typically connected to the belt pulley 43*a* but is connected to the ejector 36 and the thruster 36*a* to be disconnectable from the ejector 36 and the thruster 36*a* through an electromagnetic clutch 46.

When the belt pulley 43*a* is driven counterclockwise in the drawing, the bundle pawl 38, the ejector 36, and the thruster 36*a* move on the conveyance surface 18*a* of the processing tray 18 from the upstream side to the downstream side (the left side in the drawing) in the conveying direction. When the belt pulley 43*a* is driven clockwise in the drawing, the bundle pawl 38, the ejector 36, and the thruster 36*a* move on the conveyance surface 18*a* of the processing tray 18 to the upstream side (the right side in the drawing) in the conveying direction.

The vertical alignment roller 40 is driven counterclockwise in the drawing such that the sheet S placed on the processing tray 18 is conveyed toward the movable tray 14*a* of the discharge unit 14. The vertical alignment roller 40 comes into contact with the sheet S placed on the processing tray 18 from below so as to apply a driving force to the sheet S. At this time, as illustrated in FIG. 2, when the sheet S on the processing tray 18 is bent to be separated from the vertical alignment roller 40, the driving force of the vertical alignment roller 40 cannot be applied to the sheet S. Accordingly, the pinch roller 47 that pinches the sheet S such that the sheet S is interposed between the pinch roller 47 and the vertical alignment roller 40 is provided above the processing tray 18 (in the embodiment, above the standby tray 17) as a pressing roller.

The pinch roller 47 is a driven roller not having a drive source. The pinch roller 47 is movable between a standby position (refer to FIG. 2) that is positioned above the standby tray 17 and a rotation position (refer to FIG. 3) that faces the vertical alignment roller 40.

Figure 3:
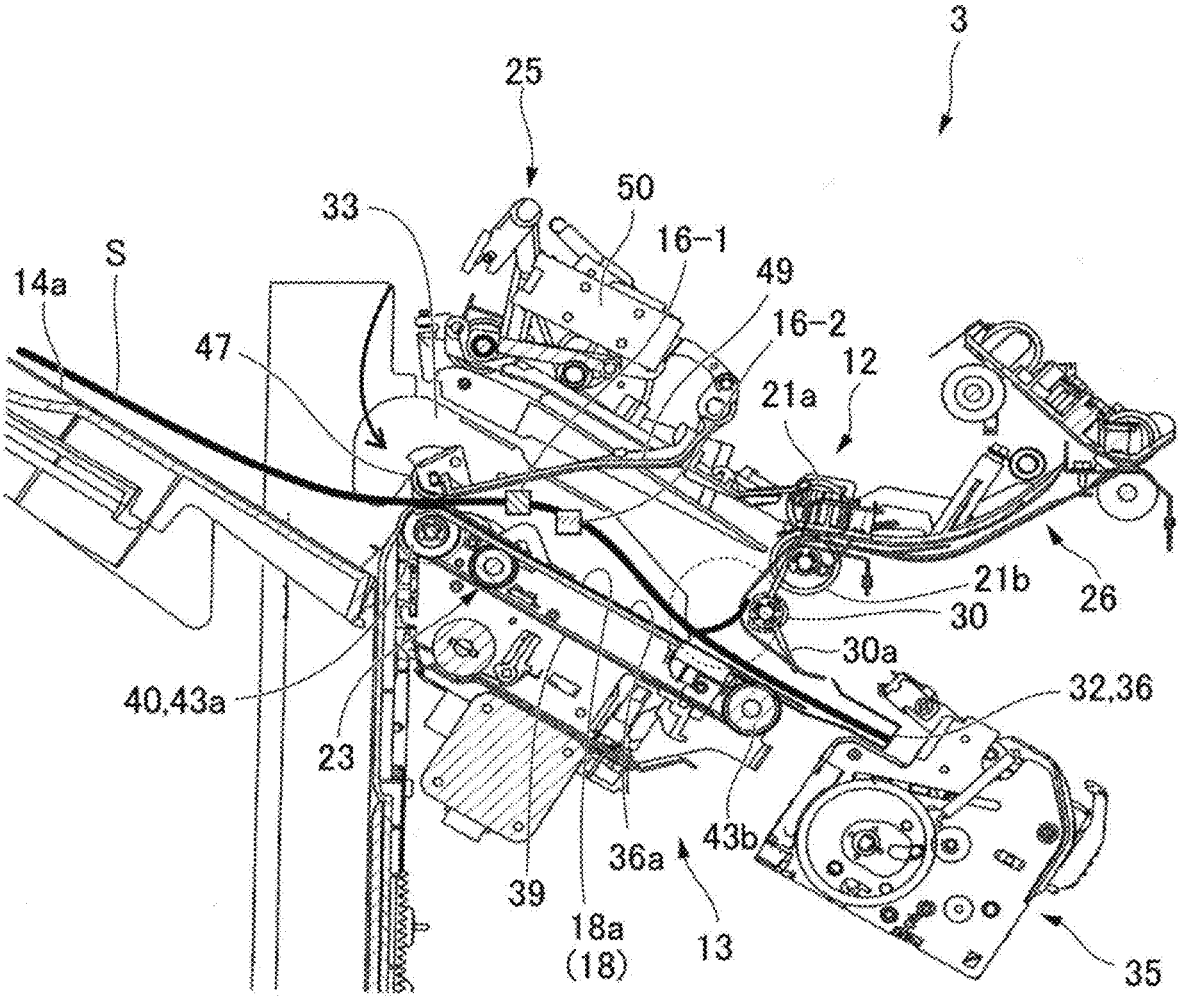
FIG. 3 is a diagram illustrating a pinch roller that is positioned at a rotation position facing a vertical alignment roller according to the embodiment.

FIG. 3 is a diagram illustrating the pinch roller 47 that is positioned at the rotation position facing the vertical alignment roller 40 according to the embodiment. The pinch roller 47 moves between the standby position and the rotation position by being driven by the pinch roller driving mechanism 25. The pinch roller 47 moves (is lowered) to the lower rotation position to be pressed against the vertical alignment roller 40 such that the sheet S is interposed between the pinch roller 47 and the vertical alignment roller 40. As a result, the driving force of the vertical alignment roller 40 can be stably applied to the sheet S.

Figure 4:
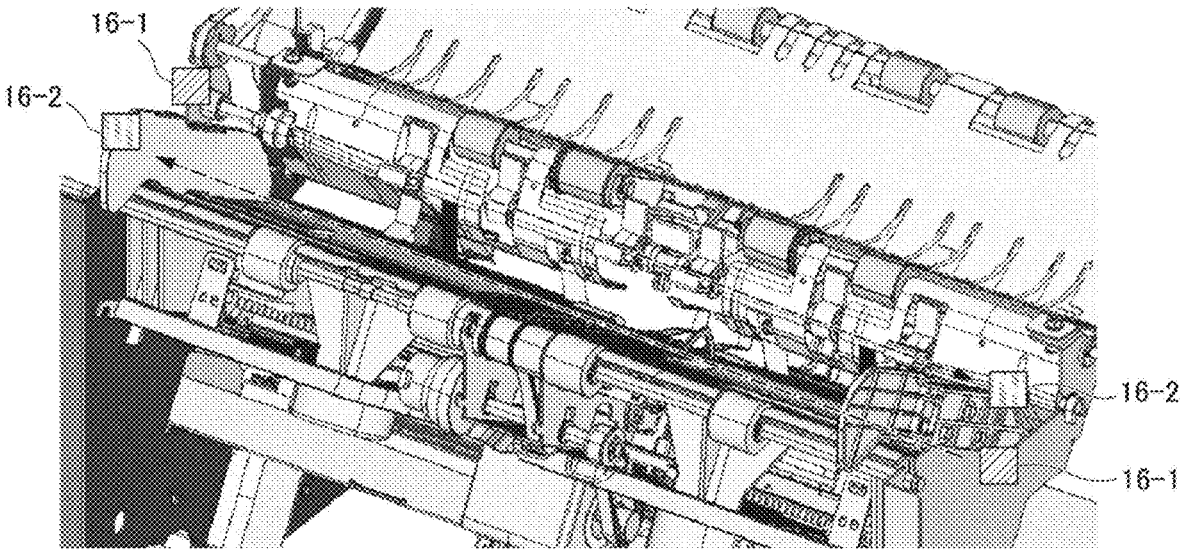
FIG. 4 is a diagram illustrating positions of a sensor transmitter and a sensor receiver according to the embodiment.

The pinch roller driving mechanism 25 illustrated in FIGS. 2 and 3 includes a support arm 49 that supports the pinch roller 47 at a tip portion (front end portion) and a base end portion (rear end portion) that is axially swingable along the sheet width direction W. A solenoid 50 is connected to the base end portion of the support arm 49. As illustrated in FIG. 3, when the solenoid 50 drives a plunger to protrude, the pinch roller 47 axially swings upward through the support arm 49 to move to the standby position. As illustrated in FIG. 4, when the solenoid 50 drives the plunger to be recessed (attracted), the pinch roller 47 swings downward through the support arm 49 to move to the rotation position. At the rotation position, the pinch roller 47 presses the vertical alignment roller 40.

The sheet S conveyed from the conveyance path 26 passes through a relatively large step and a relatively large space to the vertical alignment roller 40 of the processing tray 18. Therefore, the processing tray 18 may include a slope-shaped guide (not illustrated) that protrudes from and is recessed to the conveyance surface 18*a*.

FIG. 4 is a diagram illustrating positions of the sensor transmitter 16-1 and the sensor receiver 16-2 according to the embodiment. The sensor transmitter 16-1 is provided at one end of the processing tray 18 in the sheet width direction. The sensor receiver 16-2 is provided at the other end of the processing tray 18 in the sheet width direction. The post-processing apparatus 3 may include one sensor pair 16 or may include plural sensor pairs 16. FIG. 4 illustrates a state where the post-processing apparatus 3 includes two sensor pairs 16.

Referring back to FIGS. 1 to 3, the post-processing controller 15 determines an operation mode of the image forming system 1. Specifically, when the automatic post-processing mode is selected in the control panel 5, the post-processing controller 15 determines that the operation mode of the post-processing apparatus 3 is the automatic post-processing mode. When the manual operation mode is selected in the control panel 5, the post-processing controller 15 determines that the operation mode of the post-processing apparatus 3 is the manual operation mode. The post-processing controller 15 acquires the sensor information acquired by the sensor receiver 16-2.

The post-processing controller 15 instructs the image forming apparatus 2 to execute an image forming process.

The image forming apparatus 2 that is instructed to execute the image forming process forms an image on the sheet S.

The post-processing controller 15 controls operations of the inlet roller 20*a*, the inlet roller 20*b*, the sheet supply port 26*a*, the outlet roller 21*a*, and the outlet roller 21*b* such that the sheet S is stacked on the standby tray 17 of the standby unit 12. A plurality of sheets S stacked on the standby tray 17 are the sheet bundle SS.

The post-processing controller 15 executes a falling process. In response to the execution of the falling process by the post-processing controller 15, the standby tray 17 moves the sheet bundle SS to the processing tray 18. For example, the standby tray 17 separates a pair of tray members that can move toward or away from each other such that the sheet bundle SS is moved to the processing tray 18. Due to the execution of the falling process, the sheet bundle positioned on the standby tray 17 falls toward the processing tray 18.

The post-processing controller 15 instructs the pinch roller 47 to be raised or lowered. The pinch roller 47 that is instructed to be raised is raised. When the pinch roller 47 is raised, an area in contact with the post-processing space and the outside space is widened. When the pinch roller 47 is positioned at the uppermost position, the area in contact with the post-processing space and the external space is, for example, an area in which the back of a hand of a person can be inserted into the post-processing space. The pinch roller 47 that is instructed to be lowered is lowered. When the pinch roller 47 is lowered, the area in contact with the post-processing space and the outside space is narrowed. When the pinch roller 47 is positioned at the lowermost position, for example, the post-processing space and the outside space do not communicate with each other.

The post-processing controller 15 instructs the processing unit 13 to execute an alignment process. The alignment process is a process of aligning positions of end portions of a plurality of sheets S in a width direction and a length direction. When the processing unit 13 executes the alignment process, the horizontal alignment plate 33 or the vertical alignment roller 40 operates such that the positions of the end portions of the sheets S in the width direction and the length direction are aligned. The length direction of the sheet S is a direction perpendicular to the sheet width direction.

The post-processing controller 15 instructs the stapler 35 to execute the post-processing. The stapler 35 that is instructed to execute the post-processing executes the post-processing on the sheet bundle SS. The post-processing controller 15 instructs the ejector 36 to execute a paper discharge process. The ejector 36 that is instructed to execute the paper discharge process discharges the sheet bundle on which the post-processing is executed to the outside of the post-processing apparatus 3. In the manual operation mode, the post-processing controller 15 instructs the stapler 35 to execute a stapler movement process. The stapler 35 that is instructed to execute the stapler movement process moves up to a position indicated by the stapling position information. The post-processing controller 15 controls the display of the control panel 5.

The post-processing controller 15 determines whether or not the sensor pair 16 detects an object at a predetermined timing (hereinafter, referred to as "determination timing") based on the sensor information. When the post-processing controller 15 can determine whether or not the sensor pair 16 detects an object at the determination timing based on the sensor information, the post-processing controller 15 may determine that the sensor pair 16 detects the object or does not detect the object at the determination timing based on the sensor information. The determination timing may be any timing as long as it is a timing that is earlier than the execution of the post-processing and at which the possibility that the sensor pair 16 detects the sheet bundle SS is lower than a predetermined value. That is, the determination timing may be any timing as long as it is a timing other than a timing at which it is estimated that the sheet bundle SS does not pass through a path where an electromagnetic wave radiated from the sensor transmitter 16-1 propagates. For example, the determination timing may be a timing after lowering the pinch roller 47. For example, the determination timing may be a timing after finishing the alignment process. For example, the determination timing may be a timing after finishing the falling process. For example, the determination timing may be a timing at which the sheet bundle SS is conveyed to the processing tray 18. In a case where the determination timing is a timing after finishing the falling process or a timing after finishing the alignment process, the probability that the sensor pair 16 detects the sheet S when the sheet falls in the falling process decreases.

For example, by executing a first detection determination process and a second detection determination process, the post-processing controller 15 determines whether or not the sensor pair 16 detects an object at the determination timing. The first detection determination process is a process of determining whether or not the sensor information indicates that the object is detected. The second detection determination process is a process that is executed when the sensor information indicates that the object is detected and determines whether or not the timing at which the object is detected is the determination timing.

For example, by operating the sensor pair 16 only at the determination timing to determine whether or not the sensor information acquired from the sensor pair 16 indicates that the object is detected, the post-processing controller 15 may determine whether or not the sensor pair 16 detects the object at the determination timing.

When the manual operation mode is selected in the control panel 5, the post-processing controller 15 determines whether or not the execution information is input.

Figure 5:
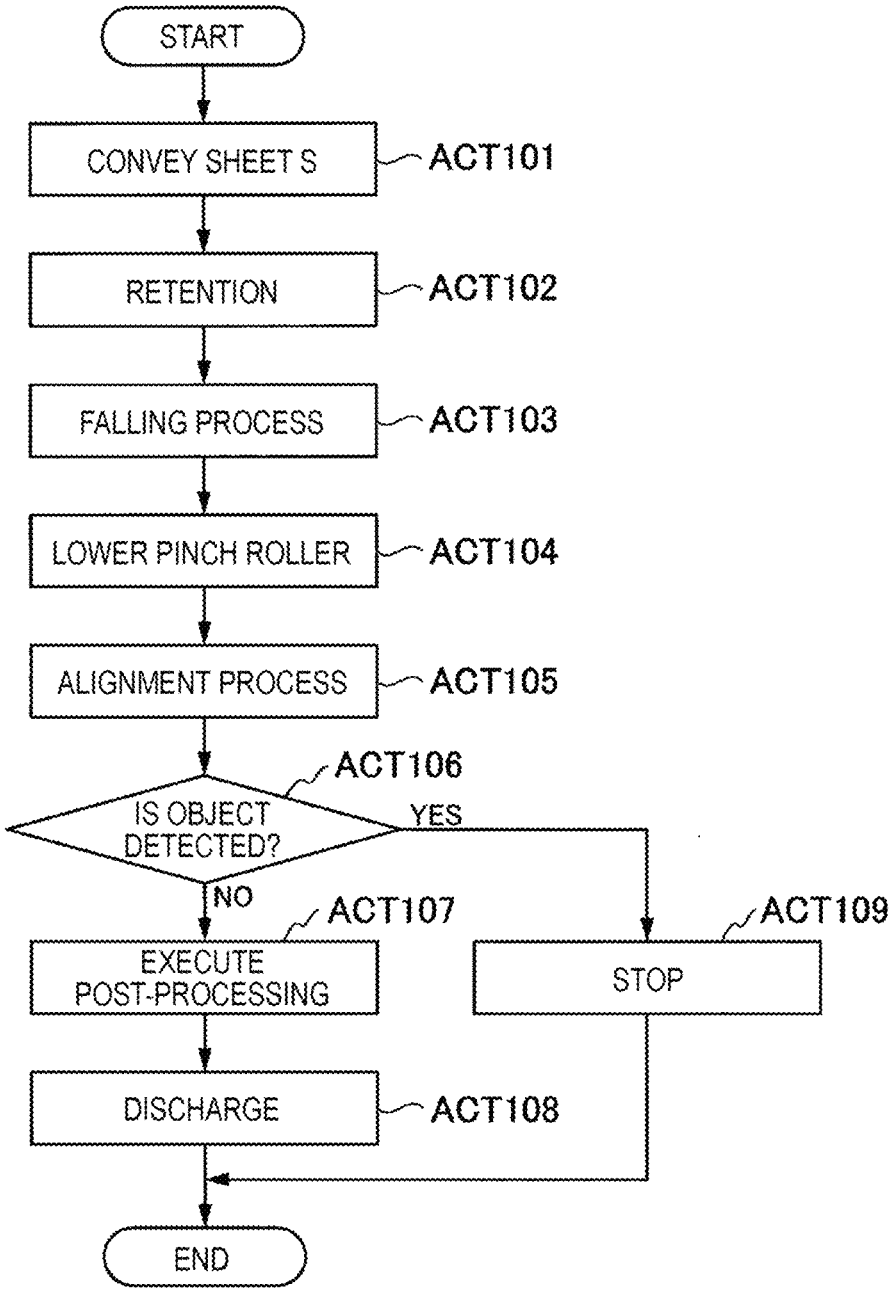
FIG. 5 is a flowchart illustrating the flow of processes that are executed by the image forming system according to the embodiment in an automatic post-processing mode.

FIG. 5 is a flowchart illustrating the flow of processes that are executed by the image forming system 1 according to the embodiment in the automatic post-processing mode.

The sheet S is conveyed from the image forming apparatus 2 to the standby tray 17 (ACT 101). The sheet S is retained in the standby tray 17 (ACT 102). In response to the execution of the falling process, the sheet S retained in the standby tray 17 is conveyed to the processing tray 18 (ACT 103).

After ACT 103, the pinch roller 47 is lowered under the control of the post-processing controller 15 (ACT 104). After ACT 104, the processing unit 13 executes the alignment process under the control of the post-processing controller 15 (ACT 105). After ACT 105, the post-processing controller 15 determines whether or not the sensor pair 16 detects an object at the determination timing based on the sensor information (ACT 106).

When the sensor pair 16 does not detect the object at the determination timing (ACT 106: NO), the post-processing is executed under the control of the post-processing controller 15 (ACT 107). After ACT 108, the sheet bundle SS on which the post-processing is executed is discharged (ACT 108).

On the other hand, when the sensor pair 16 detects the object at the determination timing (ACT 106: YES), the post-processing apparatus 3 executes an emergency stop (ACT 109). The emergency stop is an operation of stopping the operation of the post-processing apparatus 3 without executing the post-processing. When the operation of the post-processing apparatus 3 is stopped, specifically, the operation of the post-processing controller 15 is stopped. The emergency stop may be an operation of stopping the post-processing apparatus 3 without executing the post-processing after the pinch roller 47 is raised. In ACT 109, when the post-processing is not executed, it is not necessary to stop the operation of the post-processing apparatus 3.

The process of ACT 105 is not necessarily executed.

Figure 6:
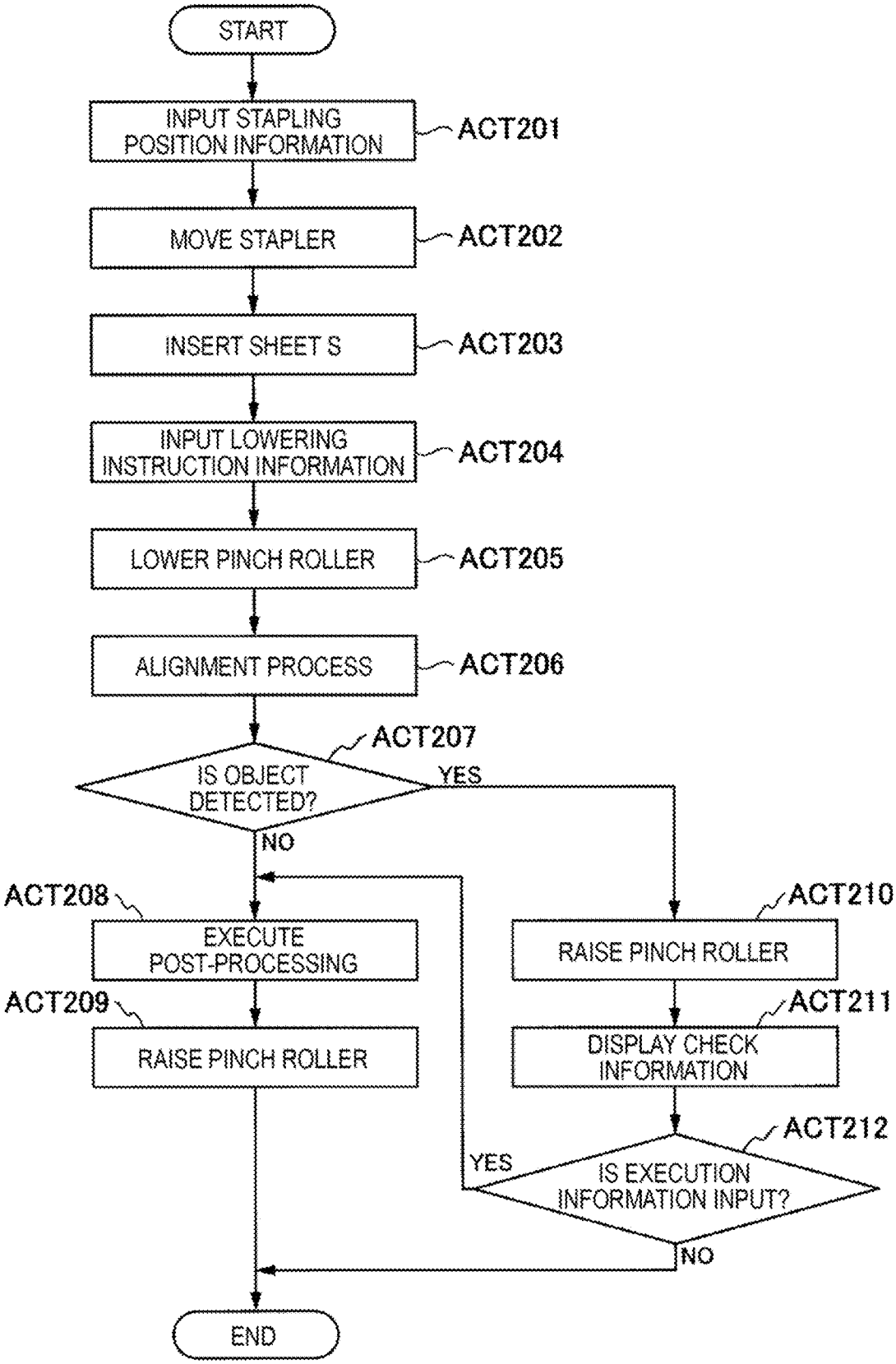
FIG. 6 is a flowchart illustrating the flow of processes that are executed by the image forming system according to the embodiment in a manual operation mode.

FIG. 6 is a flowchart illustrating the flow of processes that are executed by the image forming system 1 according to the embodiment in the manual operation mode.

The stapling position information is input through the control panel 5 (ACT 201). When the stapling position information is input, the stapler 35 moves up to a position indicated by the stapling position information under the control of the post-processing controller 15 (ACT 202). After ACT 203, the sheet S is inserted from the outside of the image forming system 1 to the post-processing space. Specifically, the sheet S is conveyed from the outside and is stacked on the processing tray 18 (ACT 203). After ACT 203, the lowering instruction information is input to the image forming system 1 through the control panel 5 (ACT 204). When the lowering instruction information is input, the pinch roller 47 is lowered under the control of the post-processing controller 15 (ACT 205). After ACT 205, the processing unit 13 executes the alignment process under the control of the post-processing controller 15 (ACT 206).

After ACT 206, the post-processing controller 15 determines whether or not the sensor pair 16 detects an object at the determination timing based on the sensor information (ACT 207).

When the sensor pair 16 does not detect the object at the determination timing (ACT 207: NO), the post-processing is executed under the control of the post-processing controller 15 (ACT 208). After ACT 208, the pinch roller is raised under the control of the post-processing controller 15 (ACT 209).

On the other hand, when the sensor pair 16 detects the object at the determination timing (ACT 207: YES), the pinch roller 47 is raised under the control of the post-processing controller 15 (ACT 210). After ACT 210, the post-processing controller 15 displays information (hereinafter, referred to as "check information") urging a user to check whether or not to execute the post-processing on the control panel (ACT 211). When the user can recognize the check information, it is not necessary to output the check information to the control panel 5. For example, a sound may be output.

After the process of ACT 211, when the execution information is input by the user (ACT 212), the process of ACT 208 is executed.

On the other hand, after the process of ACT 211, when the execution information is not input by the user (ACT 212: NO), the post-processing apparatus 3 does not execute the process. For example, when a given period of time is elapsed without executing the process, the post-processing apparatus 3 stops the operation.

Figure 7:
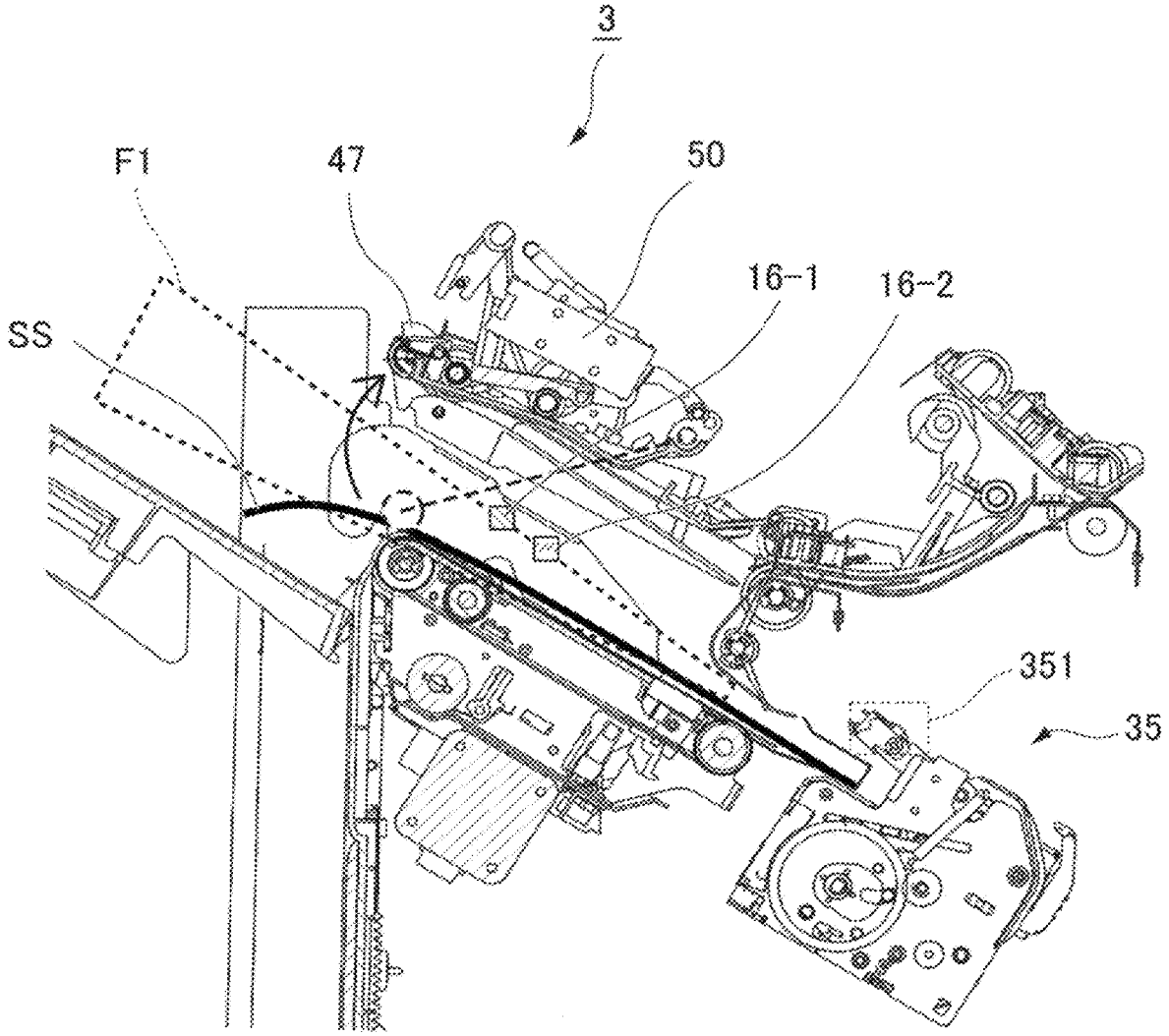
FIG. 7 is a diagram illustrating a state of the post-processing apparatus in which an emergency stop operation according to the embodiment is executed.

FIG. 7 is a diagram illustrating an example of a state of the post-processing apparatus 3 in which the emergency stop operation according to the embodiment is executed.

The post-processing apparatus 3 is stopped when an object is present in the post-processing space. The object is, for example, a human body part F1 such as a hand or a finger. When the human body part F1 is present in the post-processing space, the sensor pair 16 detects the human body part F1. Therefore, the post-processing apparatus 3 executes the emergency stop. When the emergency stop operation is executed, the staple clinch 351 stops the operation. FIG. 7 illustrates a state where the pinch roller 47 is raised when the emergency stop operation is executed. When the emergency stop operation is executed, the solenoid 50 stops the operation.

Figure 8:
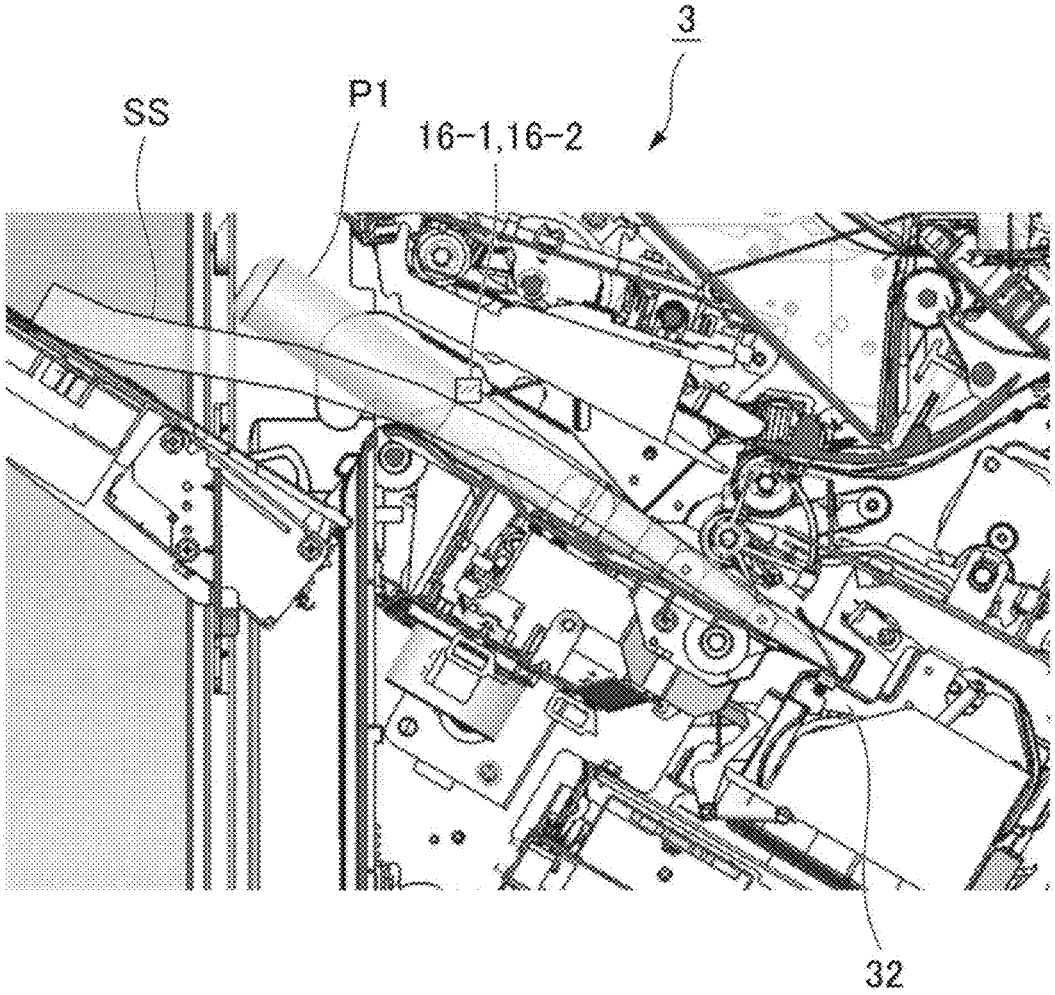
FIG. 8 is a diagram illustrating a state where the post-processing apparatus according to the embodiment detects a test probe without detecting a sheet bundle.

FIG. 8 is a diagram illustrating an example of a state where the post-processing apparatus 3 according to the embodiment detects a test probe P1 without detecting the sheet bundle SS. The test probe P1 is a probe that is formed in a form simulating a human hand.

FIG. 8 illustrates an example of a position relationship between the sheet bundle SS that expands to the maximum, the test probe P1, and the sensor pair 16. Expanding to the maximum represents a state of the sheet bundle SS where the density of a plurality of sheets S in a stacking direction is lower than a predetermined density. Hereinafter, the thickness of the sheet bundle SS that expands to the maximum will be referred to as "maximum sheet thickness". In FIG. 8, an electromagnetic wave radiated from the sensor transmitter 16-1 propagates in a direction perpendicular to the paper plane and is received by the sensor receiver 16-2. Before the electromagnetic wave radiated from the sensor transmitter 16-1 is received by the sensor receiver 16-2, the sensor pair 16 detects the test probe P1 and positions the sheet bundle SS that expands to the maximum at a position where the sheet bundle SS is not detected. In FIG. 8, the electromagnetic wave radiated from the sensor transmitter 16-1 propagates the upper side of the sheet bundle SS that expands to the maximum. Therefore, in FIG. 8 the post-processing apparatus 3 does not detect the sheet bundle SS. On the other hand, in FIG. the electromagnetic wave radiated from the sensor transmitter 16-1 is incident on the test probe P1. Therefore, in FIG. 8, the post-processing apparatus 3 detects the test probe P1. As a result, when FIG. 8 is a diagram at the determination timing, the post-processing apparatus 3 determines that the object is present in the post-processing space and executes the emergency stop.

This way, when an object having a thickness more than a predetermined thickness (hereinafter, referred to as "reference thickness") is positioned in the post-processing space, the post-processing apparatus 3 executes the emergency stop. The thickness refers to the length in the sheet stacking direction on the processing tray. The predetermined thickness refers to the length corresponding to a position (that is, a position in the detection range) where the electromagnetic wave radiated from the sensor transmitter 16-1 propagates, and the length being the distance from the processing tray 18 to the position where the electromagnetic wave passes through. For example, when the electromagnetic wave radiated from the sensor transmitter 16-1 propagates a position where the height from the processing tray 18 is V2, the predetermined thickness is V2. That is, the detection range of the sensor pair 16 is a space positioned at a position at the predetermined distance V2 or more from the processing tray 18.

Figure 9:
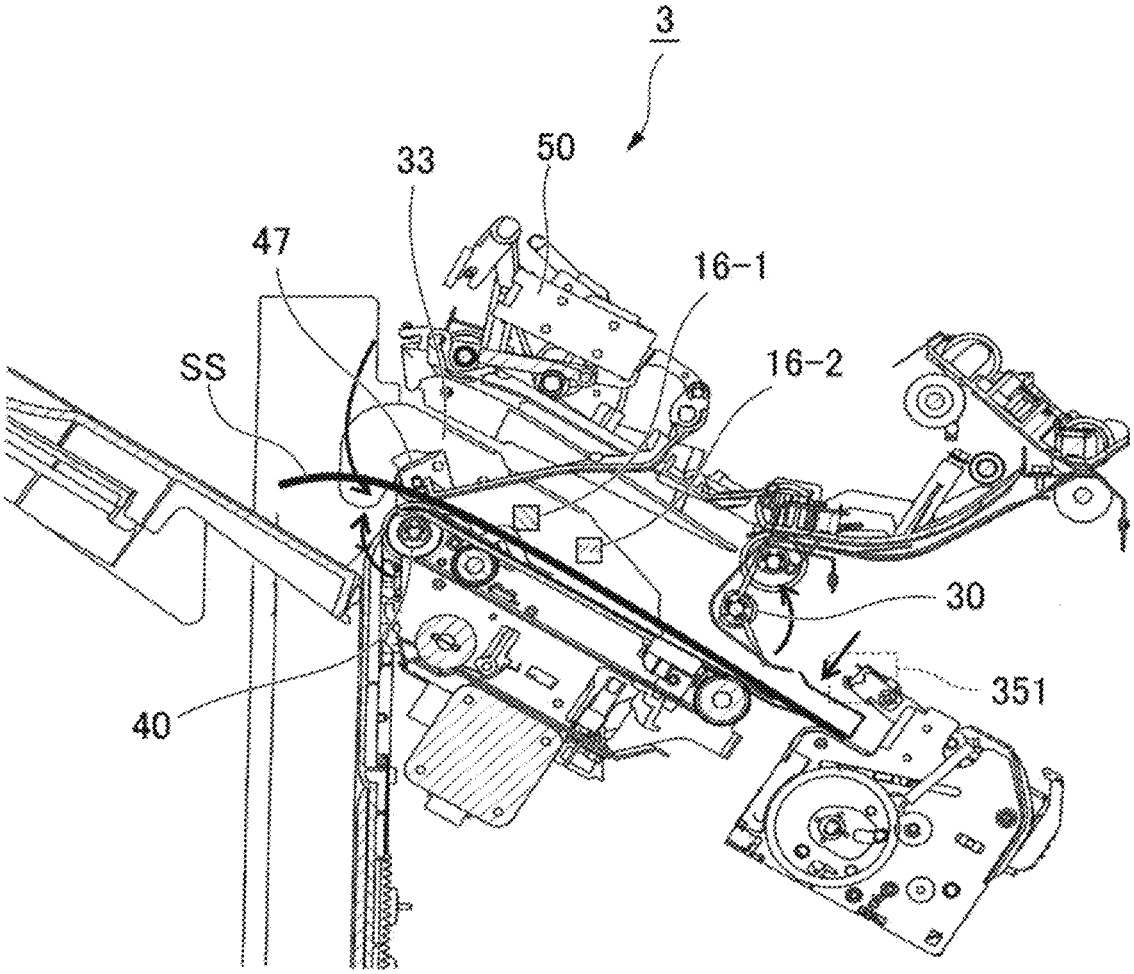
FIG. 9 is a diagram illustrating a state of the post-processing apparatus in which a post-processing is executed in the embodiment.

FIG. 9 is a diagram illustrating a state of the post-processing apparatus 3 in which the post-processing according to the embodiment is executed.

In FIG. 9, in the post-processing space, the sheet bundle SS is positioned and the human body part F1 is not positioned. The sheet bundle SS is positioned at a position where the electromagnetic wave transmitted from the sensor transmitter 16-1 is not incident. Therefore, the post-processing apparatus 3 can execute the post-processing. FIG. 9 illustrates a state where the pinch roller 47 is lowered before the post-processing is executed. FIG. 9 illustrates a state where the alignment process is executed by the horizontal alignment plate 33 and the vertical alignment roller 40 before the post-processing is executed. FIG. 9 illustrates a state where a rear end portion of the sheet bundle SS is pressed toward the processing tray 18 by the paddle unit 30. FIG. 9 illustrates a state where the stapling process is executed by the staple clinch 351. The solenoid 50 operates unlike the case of the emergency stop operation.

The image forming system 1 according to the embodiment having the above-described configuration determines whether or not the sensor pair 16 detects an object. When an object having a thickness more than the reference thickness is present in the post-processing space, the image forming system 1 stops the execution of the post-processing. Therefore, in the image forming system 1 according to the embodiment having the above-described configuration, when an object enters into the post-processing apparatus 3 from the outside, a breakdown can be prevented. In addition, in the image forming system 1 according to the embodiment having the above-described configuration, the safety of the user during the post-processing can be improved. In addition, in the image forming system 1 according to the embodiment having the above-described configuration, the sensor pair 16 is positioned at the position that satisfies the transmitter condition and the receiver condition. Therefore, the frequency at which the sheet S is detected and the image forming system 1 executes the emergency stop is reduced.

The post-processing apparatus 3 may include a staple switch 60. The staple switch 60 receives an input of the stapling position information, the lowering instruction information, or the execution information in the manual operation mode.

Figure 10:
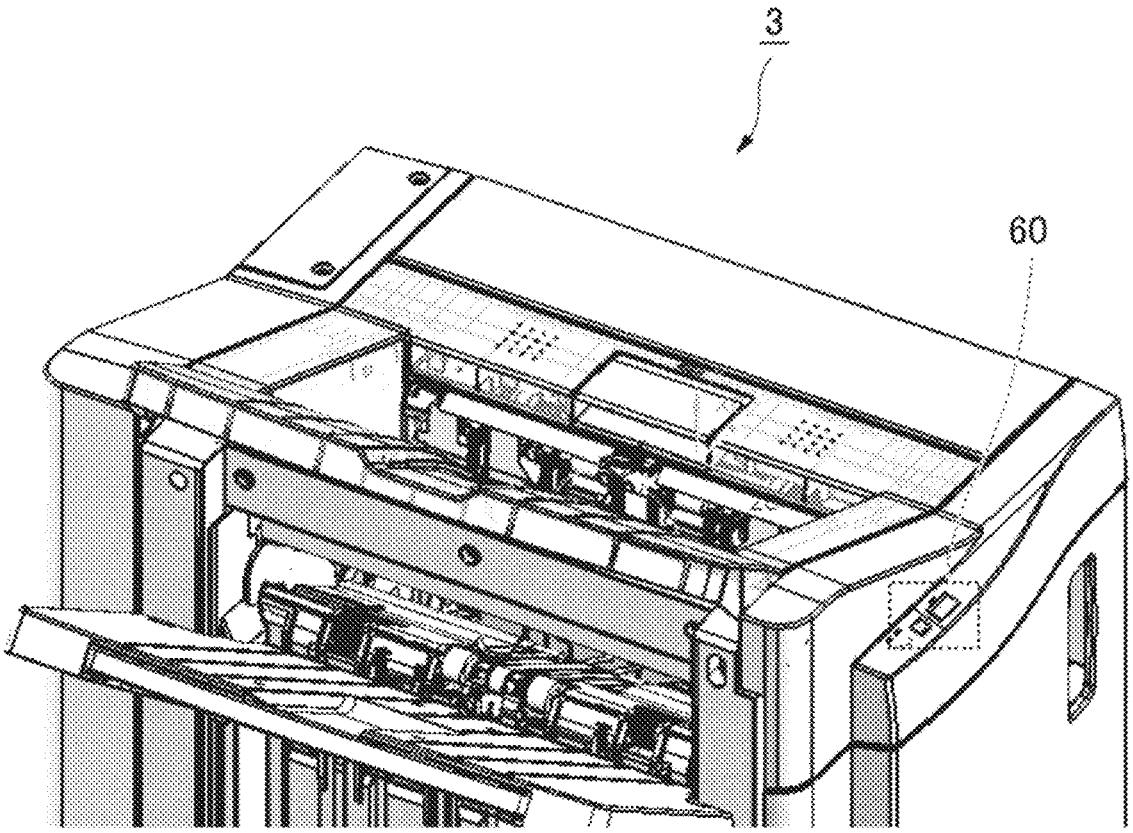
FIG. 10 is a diagram illustrating a staple switch according to another embodiment.

FIG. 10 is a diagram illustrating the staple switch 60 according to another embodiment.

The staple switch 60 is positioned at, for example, an edge of an upper surface of the post-processing apparatus 3.

It is preferable that the sensor transmitter 16-1 and the sensor receiver 16-2 are positioned at positions where the electromagnetic wave radiated from the sensor transmitter 16-1 does not propagate into folded opposite ends of the sheet bundle SS.

Figure 11A:
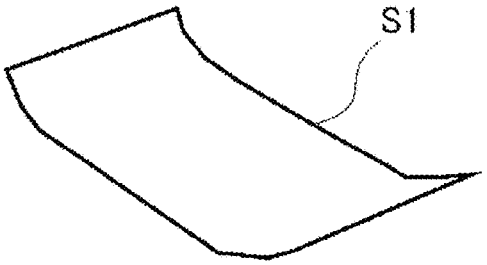
FIGS. 11A and 11B are diagrams illustrating positions of the sensor transmitter and the sensor receiver according to another embodiment.
Figure 11B:
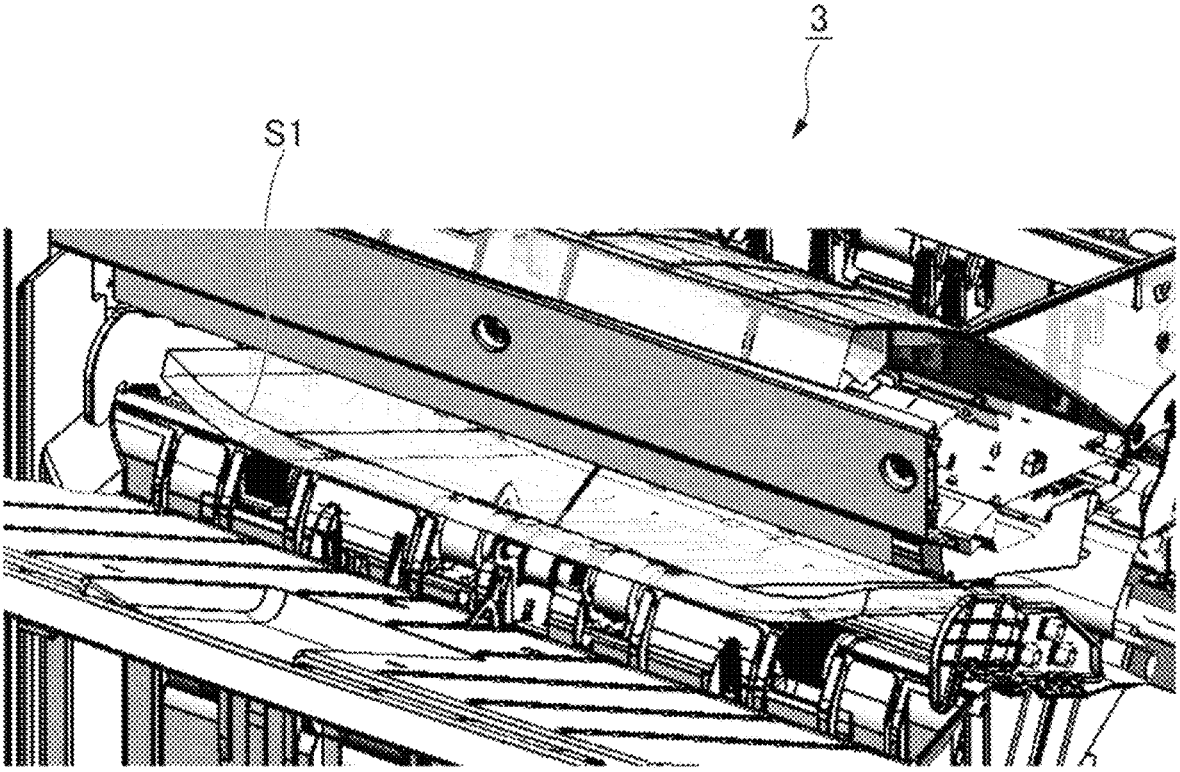

FIGS. 11A and 11B are diagrams illustrating positions of the sensor transmitter 16-1 and the sensor receiver 16-2 according to another embodiment.

FIG. 11A is a diagram illustrating a sheet S1 having folded opposite ends. The opposite ends of the sheet S1 illustrated in FIG. 11A are folded in the same direction. The center portion of the sheet S1 illustrated in FIG. 11A is flat.

FIG. 11B is a diagram illustrating a position of the sheet S1 illustrated in FIG. 11A in the post-processing apparatus 3. Since the opposite ends of the sheet S1 are folded, the height at which the sheet S1 is positioned in the post-processing apparatus 3 varies depending on the position of the sheet in the width direction. For example, when the sensor transmitter 16-1 and the sensor receiver 16-2 are positioned at the positions illustrated in FIG. 4, the post-processing apparatus 3 does not detect the sheet S1 unless the sheet S1 is not folded. On the other hand, the post-processing apparatus 3 may detect the sheet S1 because the sheet S1 is folded.

Therefore, for example, it is preferable that the sensor transmitter 16-1 and the sensor receiver 16-2 are positioned at the center in the post-processing space in the sheet width direction.

It is preferable that the path through which the electromagnetic wave radiated from the sensor transmitter 16-1 propagates up to the sensor receiver 16-2 is positioned on the downstream side in the post-processing space. When the sensor pair 16 is positioned at the above-described position, the probability that the sensor pair 16 detects the sheet S is reduced and the probability that the sensor pair 16 detects the human body increases because an arm has a larger thickness than a finger in a human hand.

Figure 12:
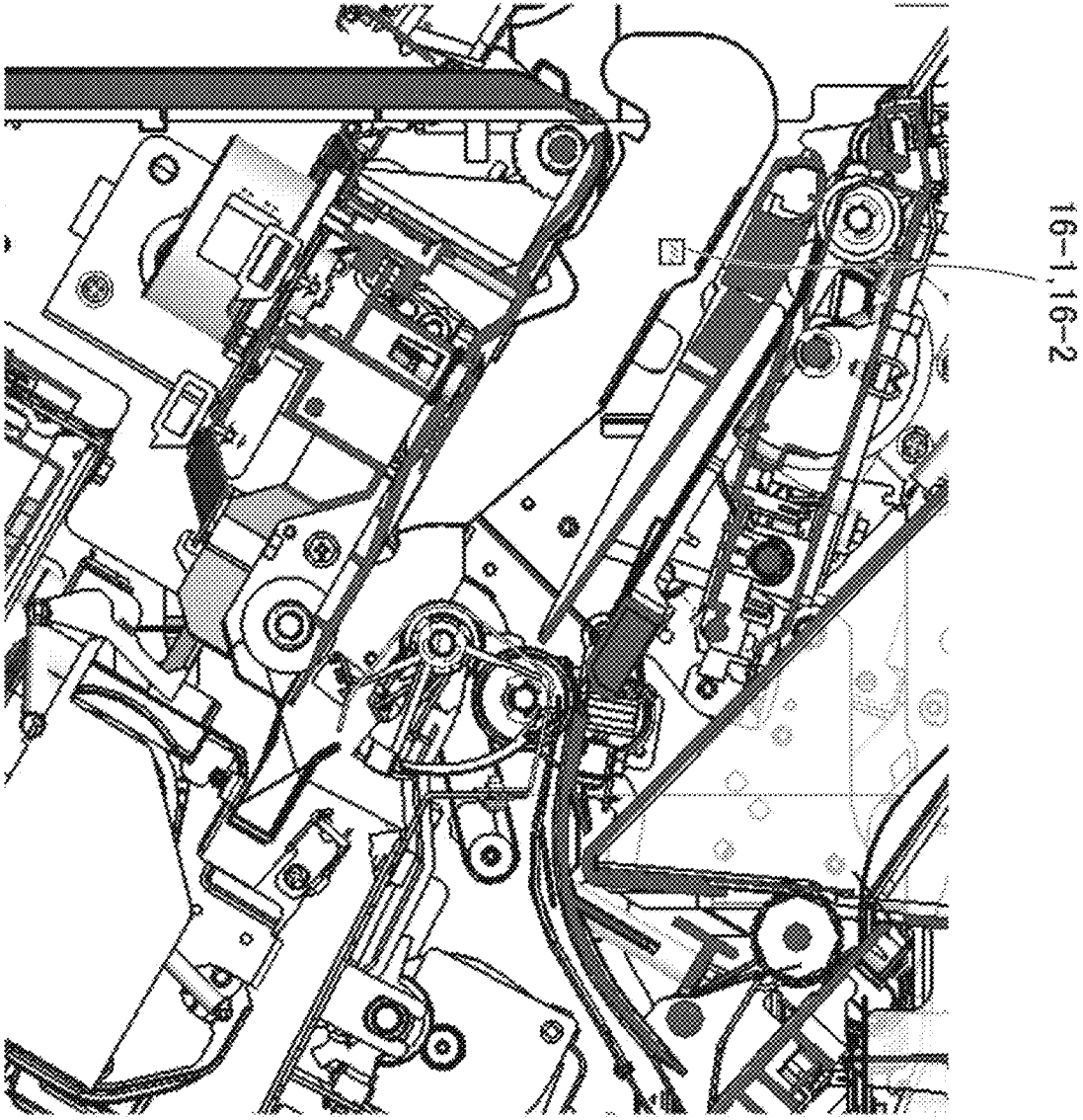
FIG. 12 is a diagram illustrating positions of the sensor transmitter and the sensor receiver according to another embodiment.

FIG. 12 is a diagram illustrating positions of the sensor transmitter 16-1 and the sensor receiver 16-2 according to another embodiment.

In FIG. 12, the sensor transmitter 16-1 and the sensor receiver 16-2 are positioned on the downstream side in the post-processing space.

In the post-processing apparatus 3, the number of sensor receivers 16-2 may be more than that of sensor transmitters 16-1. In a case where the number of sensor transmitters 16-1 is more than that of sensor receivers 16-2, even when the sensor receiver 16-2 is broken, the post-processing apparatus 3 may detect an object. When the sensor receiver 16-2 is broken, it is difficult for the user to determine whether the reason why the sensor receiver 16-2 does not receive the electromagnetic wave is that the electromagnetic wave is blocked by the object or that the sensor receiver 16-2 is broken. On the other hand, in a case where the sensor transmitter 16-1 is broken, even when an object is not present the sensor receiver 16-2 receives the electromagnetic wave. Therefore, the breakdown of the sensor transmitter 16-1 is obvious to the user. Thus, when the number of sensor receivers 16-2 is more than that of sensor transmitters 16-1, the user can easily manage the post-processing apparatus 3.

Figure 13:
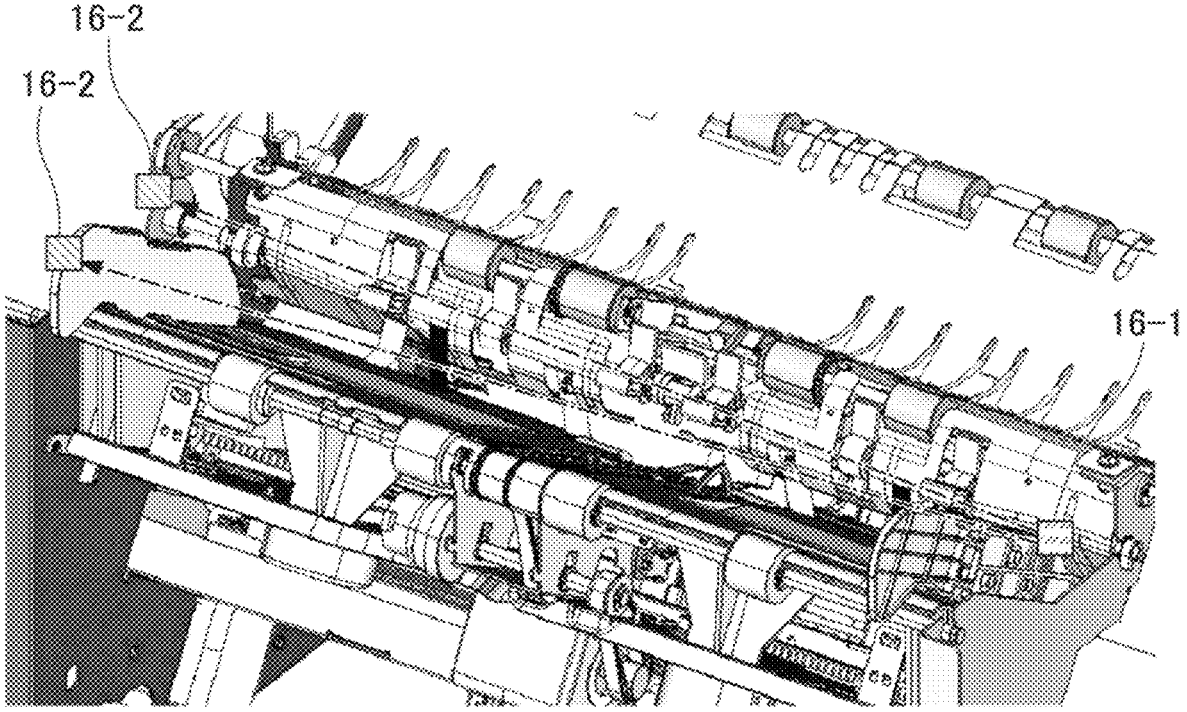
FIG. 13 is a diagram illustrating positions of the sensor transmitter and the sensor receiver according to another embodiment.

FIG. 13 is a diagram illustrating positions of the sensor transmitter 16-1 and the sensor receiver 16-2 according to another embodiment.

In FIG. 13, the post-processing apparatus 3 includes one sensor transmitter 16-1 and two sensor receivers 16-2. An electromagnetic wave radiated from the single sensor transmitter 16-1 is received by the two sensor receivers 16-2.

The sensor pair 16 is an example of the detection sensor.

Figure 14:
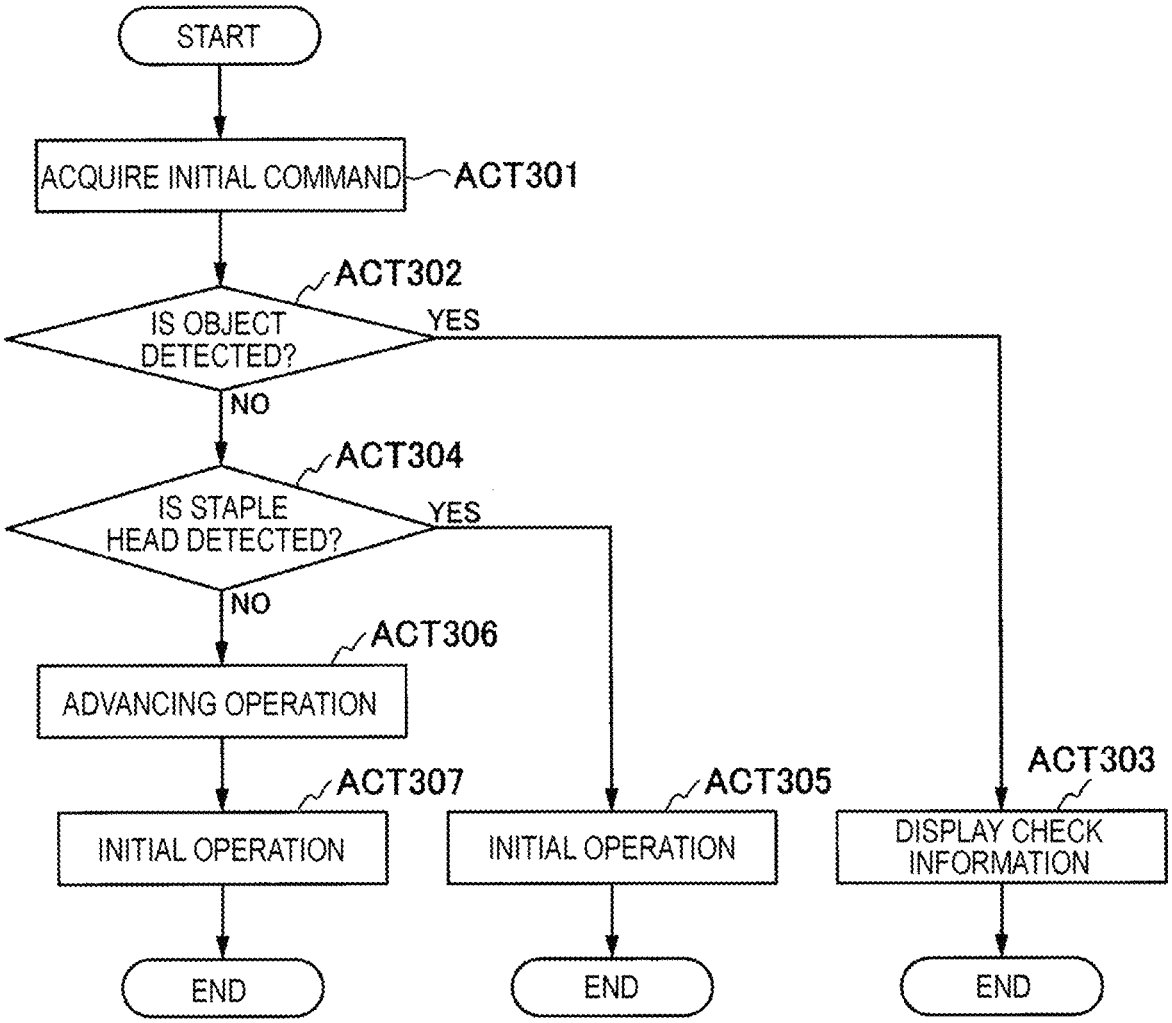
FIG. 14 is a flowchart illustrating the flow of processes that are executed by the image forming system according to another embodiment.

The post-processing apparatus 3 may be configured to stop execution of an operation relating to a staple when the sensor pair 16 detects an object. FIG. 14 is a flowchart illustrating the flow of processes that are executed by the image forming system 1 according to another embodiment. When an initial command is acquired (ACT 301), the post-processing controller 15 refers to the detection result of the sensor pair 16. The initial command is an execution instruction of an initial operation. In response to the acquisition of the initial command, the initial operation is executed. The initial operation refers to a preliminary operation for determining whether or not each device operates normally.

When the sensor pair 16 detects an object (ACT 302: YES), the post-processing controller 15 displays information (hereinafter, referred to as "risk check information")

giving a heads-up to the user or urging the user to check whether or not a hand or a finger is inserted on the control panel 5 (ACT 303). When the user can recognize the risk check information, it is not necessary to output the risk check information to the control panel 5. For example, a sound may be output.

When the sensor pair 16 does not detect an object (ACT 302: NO), the post-processing controller 15 refers to the detection result of the staple head sensor 352. When the staple head sensor 352 detects a staple (ACT 304: YES), the post-processing controller 15 executes the initial operation (ACT 305) and then continues a subsequent process. When the staple head sensor 352 does not detect a staple (ACT 304: NO), the post-processing controller 15 executes the advancing operation (ACT 306). The post-processing controller 15 repeatedly executes the advancing operation until the staple head sensor 352 detects a staple. When the staple head sensor 352 detects a staple, the post-processing controller 15 stops the execution of the advancing operation, executes the initial operation (ACT 307), and continues a subsequent process.

In the image forming system 1 according to the embodiment, even when the stapling operation or the advancing operation is executed, a breakdown caused by the entrance of an object into the post-processing apparatus 3 from the outside can be prevented. In the image forming system 1 according to the embodiment, even when the stapling operation or the advancing operation is executed, the safety of the user can be improved.

Some or all of the respective functions of the image forming apparatus 2 and the post-processing apparatus 3 may be implemented by hardware such as an Application Integrated Circuit (ASIC), a Programmable Logic Device (PLD), or a Field Programmable Gate Array (FPGA). The program may be recorded in a computer-readable recording medium. "Computer-readable recording medium" refers to a storage device, for example, a portable medium such as a flexible disk, a magneto-optic disk, a ROM, or a CD-ROM or a hard disk built into a computer system. The program may be transmitted through an electric telecommunication line.

In the image forming system 1 according to at least one of the above-described embodiments, the sensor pair 16 determines whether or not an object is detected. When an object having a thickness more than the reference thickness is present in the post-processing space, the image forming system 1 stops the execution of the post-processing. Therefore, in the image forming system 1 according to the embodiment having the above-described configuration, the safety of the user during the post-processing after forming an image can be improved.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming system comprising:

a processing tray configured to support a sheet or a sheet bundle on which a post-processing is to be executed;

a detection sensor configured to detect an object in a detection space that is above and parallel to the processing tray; and a post-processing controller configured to:

in response to a detection of the object in the detection space by the detection sensor during a determination timing other than a timing at which passage of the sheet or the sheet bundle through the detection space is estimated, prevent execution of the post-processing.

2. The system according to claim 1, wherein a distance from the processing tray to the detection space is greater than a reference thickness of a sheet bundle.

3. The system according to claim 1, wherein the determination timing is a timing at which the sheet or the sheet bundle is conveyed to the processing tray.

4. The system according to claim 1, wherein the detection sensor comprises at least one sensor transmitter including a light emitting element and at least one sensor receiver including a light receiving element, and the detection sensor comprises less sensor transmitters than sensor receivers.

5. The system according to claim 4, wherein the detection sensor detects the object when the at least one sensor receiver does not receive light from the at least one light emitting element or when an intensity of light received by the at least one sensor receiver from the at least one light emitting element is lower than a predetermined intensity.

6. The system according to claim 1, wherein the post-processing is a stapling operation, and the post-processing controller prevents execution of the stapling operation when the object is detected in the detection space by the detection sensor at a timing at which an instruction to initiate the stapling operation is received.

7. The system according to claim 1, wherein the determination timing is one of: a timing after a pinch roller is engaged with an alignment roller that engages the sheet or the sheet bundle, a timing after an alignment process of aligning positions of end portions of the sheet or the sheet bundle in a width direction and a length direction of the sheet or the sheet bundle, and a timing after the sheet or the sheet bundle falls from a standby tray above the processing tray into the processing tray.

8. The system according to claim 7, wherein the post-processing controller operates in an automatic mode or a manual mode.

9. The system according to claim 8, wherein the post-processing controller is further configured to: in the automatic mode, prior to the determination timing, retain the sheet or the sheet bundle in the standby tray above the processing tray, drop the sheet or the sheet bundle to the processing tray, engage the pinch roller with the alignment roller, and align the positions of the end portions of the sheet or the sheet bundle.

10. The system according to claim 8, wherein the post-processing controller is further configured to: in the manual mode, prior to the determination timing, move a stapler in response to stapling position information, drop the sheet or the sheet bundle to the processing tray, engage the pinch roller with the alignment roller, and align the positions of the end portions of the sheet or the sheet bundle.

11. A method of image formation and post-processing that is executed by an image forming system including a processing tray configured to support a sheet or a sheet bundle on which the post-processing is to be executed and a detection sensor configured to detect an object in a detection space that is above and parallel to the processing tray, the method comprising:

in response to a detection of the object in the detection space by the detection sensor during a determination timing other than a timing at which passage of the sheet or the sheet bundle through the detection space is estimated, preventing execution of the post-processing.

12. The method according to claim 11, wherein a distance from the processing tray to the detection space is greater than a reference thickness of a sheet bundle.

13. The method according to claim 11, wherein the determination timing is a timing at which the sheet or the sheet bundle is conveyed to the processing tray.

14. The method according to claim 11, wherein the detection sensor comprises at least one sensor transmitter including a light emitting element and at least one sensor receiver including a light receiving element, and the detection sensor comprises less sensor transmitters than sensor receivers.

15. The method according to claim 14, wherein the detection sensor detects the object when the at least one sensor receiver does not receive light from the at least one light emitting element or when an intensity of light received by the at least one sensor receiver from the at least one light emitting element is lower than a predetermined intensity.

16. The method according to claim 11, wherein the post-processing is a stapling operation, the method further comprising:

preventing execution of the stapling operation when the object is detected in the detection space by the detection sensor at a timing at which an instruction to initiate the stapling operation is received.

17. The method according to claim 11, wherein the determination timing is one of: a timing after a pinch roller is engaged with an alignment roller that engages the sheet or the sheet bundle, a timing after an alignment process of aligning positions of end portions of the sheet or the sheet bundle in a width direction and a length direction of the sheet or the sheet bundle, and a timing after the sheet or the sheet bundle falls from a standby tray above the processing tray into the processing tray.

18. The method according to claim 17, further comprising:

operating a post-processing controller in an automatic mode or a manual mode.

19. The method according to claim 18, wherein operating the post-processing controller in the automatic mode comprises: prior to the determination timing, retaining the sheet or the sheet bundle in the standby tray above the processing tray, dropping the sheet or the sheet bundle to the processing tray, engaging the pinch roller with the alignment roller, and aligning the positions of the end portions of the sheet or the sheet bundle.

20. The method according to claim 18, wherein operating the post-processing controller in the manual mode comprises: prior to the determination timing, moving a stapler in response to stapling position information, dropping the sheet or the sheet bundle to the processing tray, engaging the pinch roller with the alignment roller, and aligning the positions of the end portions of the sheet or the sheet bundle.

* * * * *